United States Patent [19]

Reed

[11] Patent Number: 4,498,276

[45] Date of Patent: Feb. 12, 1985

[54] HANDLING AND PACKAGING APPARATUS

[75] Inventor: Geoffrey R. Reed, Tadworth, England

[73] Assignees: Encomech Product Development Limited, Surrey; Head Wrightson Machine Company Limited, Cleveland, both of England

[21] Appl. No.: 277,110

[22] Filed: Jun. 25, 1981

[30] Foreign Application Priority Data

Jun. 25, 1980 [GB] United Kingdom ..... 8020824

[51] Int. Cl.[3] ..... B65B 13/12

[52] U.S. Cl. ..... 53/588; 53/204; 53/210; 100/10; 100/27

[58] Field of Search ..... 53/204, 210, 587, 588, 53/589; 100/27, 12, 10

[56] References Cited

U.S. PATENT DOCUMENTS

| | | | |
|---|---|---|---|
| 1,235,312 | 7/1917 | Hadert | 53/588 |
| 1,235,313 | 7/1917 | Hadert | 53/589 |
| 2,361,470 | 10/1944 | Flood | 53/589 X |
| 2,624,990 | 1/1953 | Allen | 53/210 X |
| 2,893,191 | 7/1959 | Lancaster | 53/214 X |
| 2,972,843 | 2/1961 | Du Broff | 53/588 |
| 3,075,324 | 1/1963 | Burks | 53/384 |
| 3,126,686 | 3/1964 | Kobylanski | 53/589 |
| 3,195,444 | 7/1965 | McLean | 100/12 X |
| 3,251,294 | 5/1966 | Hill | 100/12 X |
| 3,262,246 | 7/1966 | Olsen | 53/587 |
| 3,304,960 | 2/1967 | Keusemann | 100/12 |
| 3,699,880 | 10/1972 | Nuckel | 100/215 X |
| 3,778,963 | 12/1973 | Straujups | 53/211 |
| 3,853,051 | 12/1974 | Tyler | 100/27 |
| 4,079,565 | 3/1978 | Lancaster | 53/441 X |
| 4,109,445 | 8/1978 | Shulman | 53/588 X |
| 4,126,983 | 11/1978 | Ito | 53/593 |

FOREIGN PATENT DOCUMENTS

| | | | |
|---|---|---|---|
| 941795 | 2/1974 | Canada | 53/204 |
| 2019040 | 10/1979 | United Kingdom | 53/589 |

*Primary Examiner*—John Sipos

*Attorney, Agent, or Firm*—Cushman, Darby & Cushman

[57] ABSTRACT

Apparatus for handling and packaging coils of sheet material, especially steel strip, comprises a rotary capstan with arms that can project through the hollow core of a coil to support the coil. Successive operations of the packaging process are performed at a number of operating stations, at least one of which is so placed that its packaging operation is performed while a coil is so supported. The packaging may comprise an outer sheet metal wrapping applied by rotation of a wrapping arm about the coil to carry the wrapping sheet around the coil circumference. A feed table is provided to align the metal wrapping sheet initially with the coil. Two overlapping wrapping sheets making up a wrapping for a wider coil can be secured together by a welding arm that operates on the sheets as they are wrapped around the coil.

14 Claims, 24 Drawing Figures

IX
C
D
C1
168
170
174
176
178
180
182
184
188
190
194
196
198
200
201
202
206
208
54
56
62
64
66
70

FIG. 15
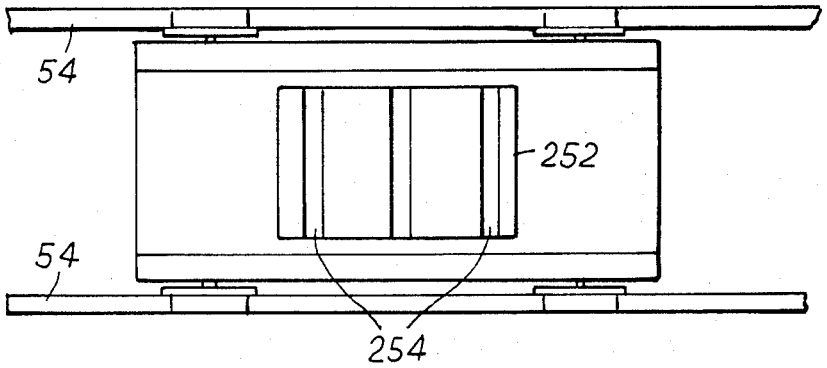
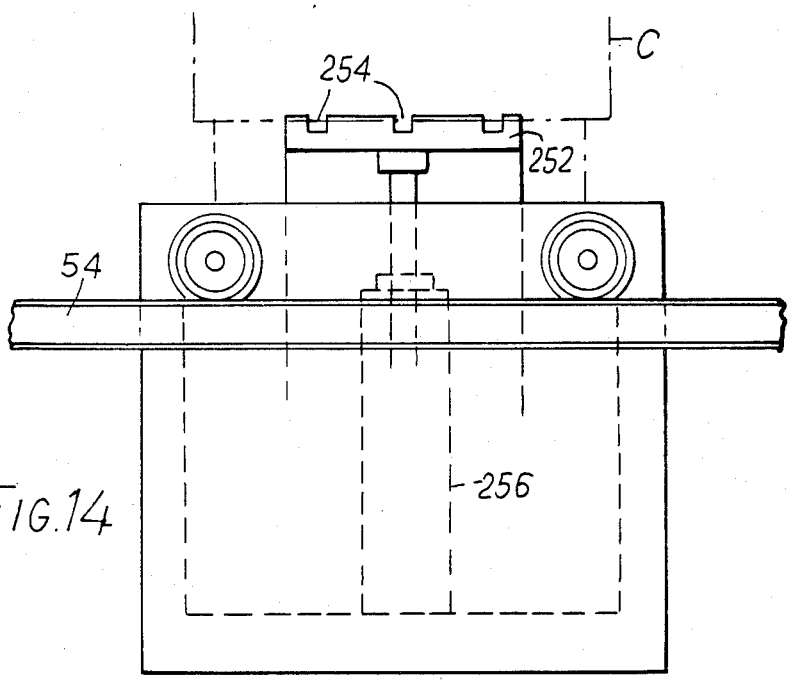
FIG. 14

10
292
294
296
300
302
304
306
62
2
4
C

HANDLING AND PACKAGING APPARATUS

BACKGROUND OF THE INVENTION

This invention relates to handling and packaging apparatus for the packaging of coils of material, such as coils of sheet metal, e.g. steel strip.

The steel strip produced in strip mills is taken off in the form of a hollow cylindrical coil that requires to be protected both against corrosion and mechanical damage in its journey to the user. It is therefore usual to package the coils, generally using an inner wrapping of paper and/or an outer wrapping of a thin sheet steel so that the coil is completely encased.

UK Patent 1275602 describes one form of packaging for coils, and a process for applying the packaging, in which each coil is lifted onto a floor-mounted conveyor which at one station has supporting rollers that allow the coil to be rotated about its own axis for applying a wrapping sheet to its outer circumference. The conveyor also has means to progress the coil axially to transfer it to a further station along the conveyor where strapping bands can be applied over the wrapping.

The process described in that earlier disclosure has a number of disadvantages. For example, it requires difficult manual operations to align the wrapping axially of the coil and around the coil. While the coil is rotating on its supporting rollers it is even more difficult to maintain that alignment of the coil with the wrapping sheet. These adjustment problems can be particularly troublesome when the width of the coil requires a pair of overlapping wrapping sheets to cover it, and where it may be necessary to secure the individual sheets together by spot welding.

The use of a single conveyor having a number of successive operation stations along its length can be very space-consuming, especially for wrapping methods that require a large number of operations. It is known in coil conveying systems to use means for angling a conveying path—e.g. indexing means that comprise horizontal arms that can be located through the hollow centre or eye of a coil to take it off one conveyor, and can be rotated about a vertical axis to locate the coil for transfer onto a further conveyor at an angle to the first conveyor, but such systems require additional space.

SUMMARY OF THE INVENTION

According to a first aspect of the present invention there is provided apparatus for packaging a coil of material comprising a rotatable transfer means having a plurality of arms extending radially to an upright axis of rotation, on each of which a coil can be supported, a plurality of stations having means for different operations of a packaging process being disposed at different angular positions about said axis of rotation, the coil being angularly displaceable by said transfer means between successive angular positions for the packaging operations, at least one said station being disposed at or adjacent the transfer means for the corresponding packaging operation or operations to be performed while said coil is on the transfer means.

It may be arranged that different stations of the packaging process are disposed on paths extending from different angular positions about the transfer means, in addition to the station or stations at which operations are performed while the coil is on the rotary transfer means.

Preferably, the angular positions or at least two of said angular positions each have the same angular spacing measured in the same direction of rotation from a preceding or succeeding angular position, whereby a plurality of arms of the rotary transfer means can be registered with a plurality of said positions simultaneously.

The conveying of the coils to and from the rotatable transfer means can be performed in various ways. Conveniently there is provided at least one rail track extending radially to the rotary transfer means and along which coils are brought to and/or taken from said transfer means, on the or each said track there being a carrier vehicle provided with lifting means for placing the coil on and removing it from an arm of the transfer means.

At the rotary transfer means there may be a paper wrapping station and/or a sheet metal wrapping station. In a particularly compact arrangement, the rotary transfer means provides a space in a central region adjacent to the rotary axis and radially inwards of the arms, in which coil wrapping means can be mounted on a support that extends outwards over the radial extent of the arms for performing a wrapping operation on a coil mounted on an arm. In a preferred construction, the arms have cranked inner ends that project upwards from spaced positions on a central hub, so as to permit a metal end cap to be positioned on the inner end of an arm without obstructing the coil before it is put into position on the coil as part of an encasing outer wrapping.

It is also possible to provide guide means on the rotary transfer means arms for passing strapping bands through the eye of a coil.

According to another aspect of the invention, there is provided apparatus for wrapping a sheet metal wrapping around a cylindrical coil of material, comprising means for rotating a wrapping arm about an axis substantially coincident with the coil axis, said arm having a member projecting from a radially outer end parallel to the rotary axis, holding means for said wrapping on said member and means being provided for adjusting the position of the holding means radially relative to said rotary axis.

In this way, the coil can be left stationary while the circumferential wrapping is applied to it so making it possible to control the operation more accurately, in particular to simplify the initial alignment of a wrapping sheet with a coil and to ensure that the alignment can be maintained as that sheet is applied to the coil. The apparatus can also include welding means carrying a welding head for securing together axially overlapping wrapping sheets, and the welding can be carried out as the sheets are applied to the coil, so eliminating the possibility of buckling.

According to a further aspect of the invention, as another aid to the application of sheet metal wrapping sheets to a coil, there is provided means for applying sheet metal wrapping sheets to a hollow cylindrical coil, comprising a mounting arranged to extend through the hollow core of the coil to support it with its axis horizontal, and a feed table provided with drive means to advance the metal wrapping sheets towards the suspended coil, said table comprising a lateral edge guide for the wrapping sheet and means for adjusting said guide to align the sheet axially of the coil.

The invention will be more particularly described with reference to the accompanying diagrammatic drawings.

DESCRIPTION OF THE PREFERRED EMBODIMENTS

Figure 1:
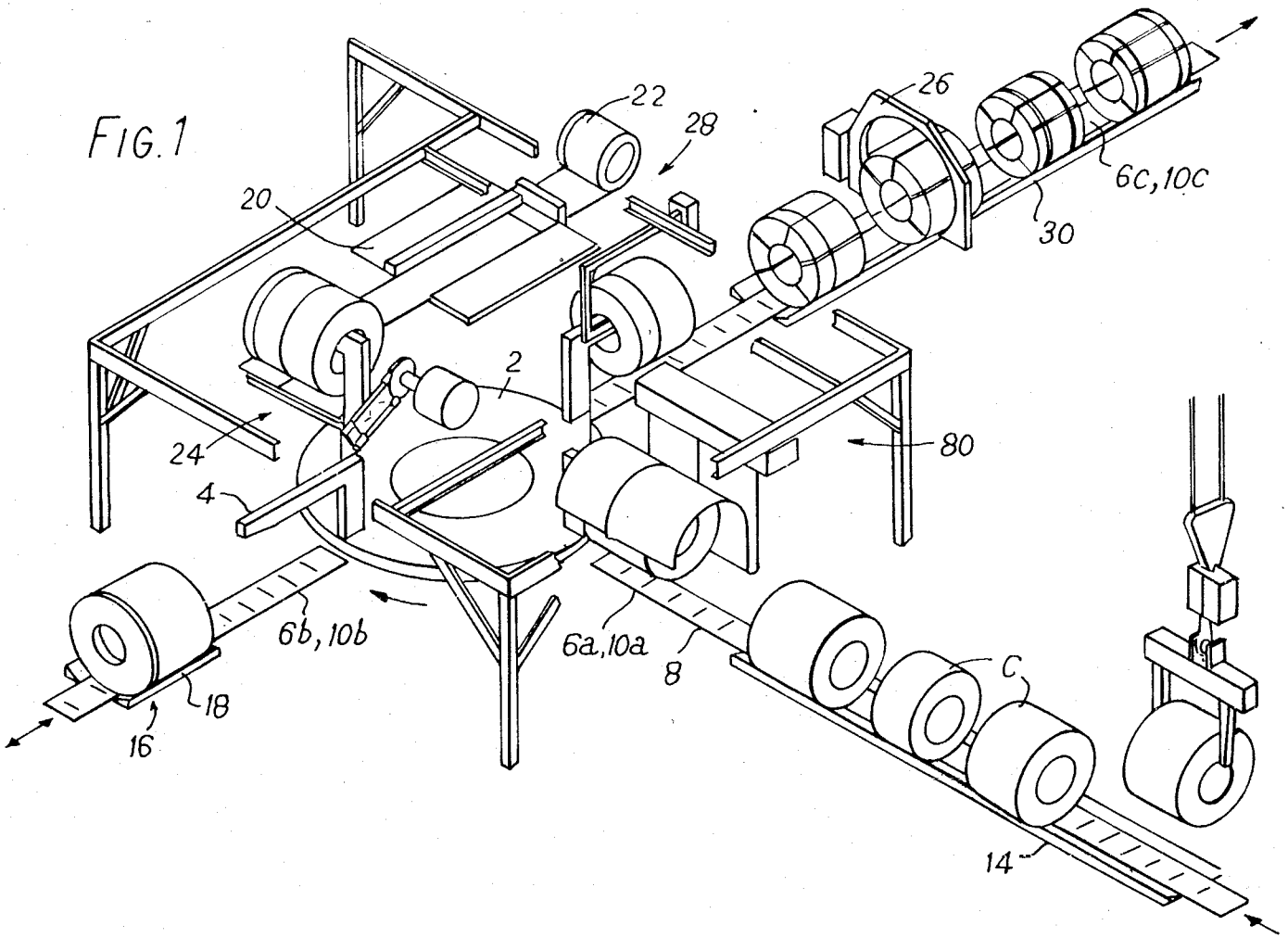
FIG. 1 is an isometric illustration of a coil packaging installation embodying the invention.
Figure 2:
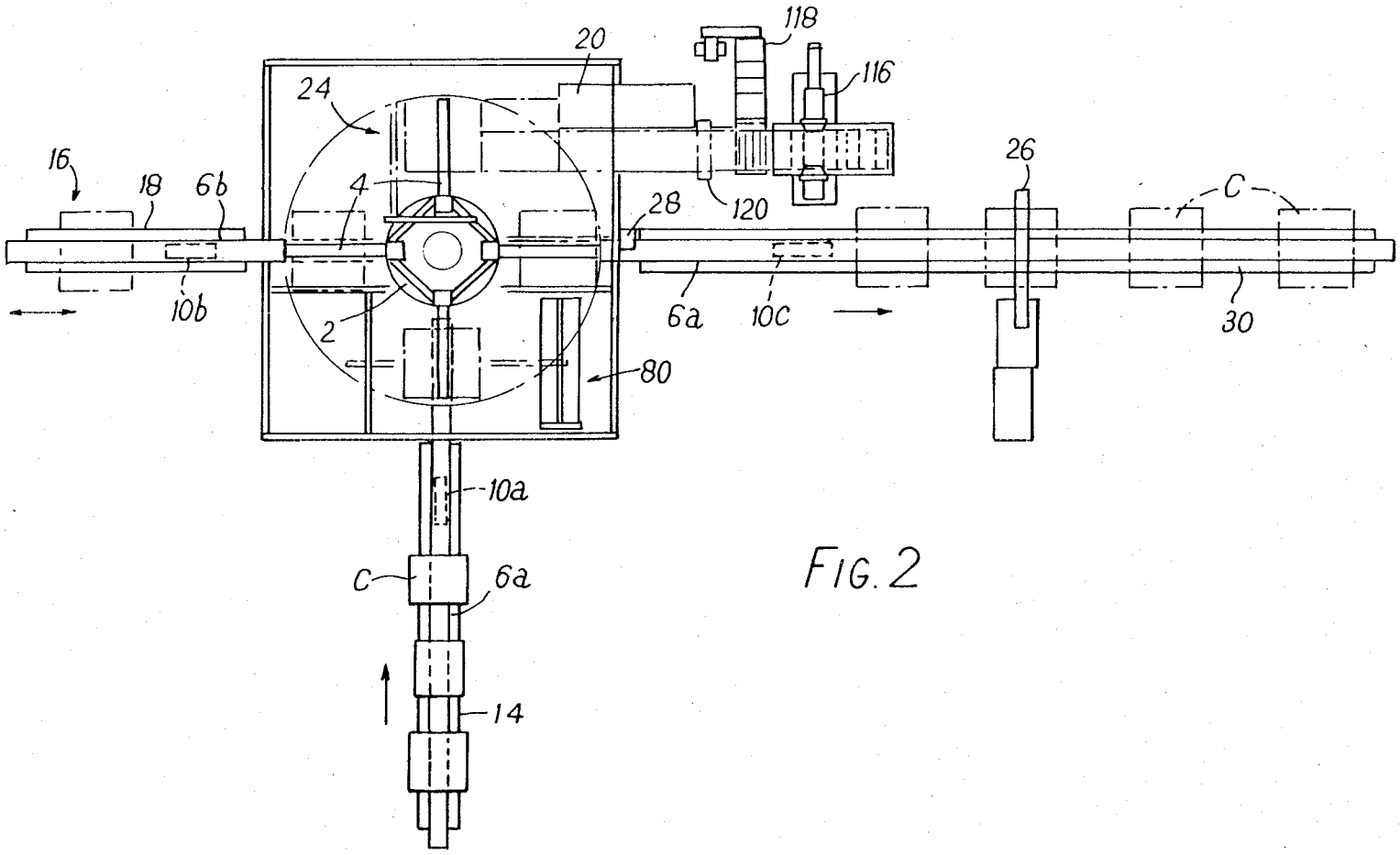
FIG. 2 is a plan view of the installation in FIG. 1.

The packaging installation shown in FIGS. 1 and 2 includes a capstan 2 rotatable on a central vertical axis and having four elongate radial arms 4 at 90° intervals and at the same level. Three tracks 6*a*, 6*b*, 6*c* extend radially from the capstan, also at 90° intervals, the tracks comprising rails in trenches or pits below the surrounding floor level and being covered by shield plates 8 substantially at floor level. Running on each track is a respective coil car 10*a*, 10*b*, 10*c* that has a load-carrying platform movable between raised and lowered positions and the shield plates form a linked belt that moves with the associated coil car to keep the rail track enclosed and form a surface substantially flush with the surrounding floor.

The coil cars carry coils C of sheet steel through the stages of the packaging process, the capstan 2 acting as a transfer device for the coils between successive tracks. The first track 6*a* extends to the capstan 2 from an entry storage trough 14 where a buffer stock of the coils C may be held. The trough is formed simply by two inwardly sloping supports on opposite sides of the track that retain coils of steel strip lowered onto them by a crane (not shown).

The second track 6*b* leads to and from packaging station 16 where stationary sloping supports 18 are able to receive a coil from the car 10*b* and hold it while the steel end caps are fitted.

At an intermediate position between the second and third tracks not normally having a coil track is situated a steel wrapping sheet feed system for feeding sheets of wrapping steel to the coil. This comprises a feed table 20 for supplying sheets cut from a wrapping coil 22, and an articulated rotatable wrapping arm and clamp assembly 24 for drawing the wrapping sheets around the coil. Both the feed table and the arm and clamp assembly will be described in more detail below.

The third track 6*c* extends through a strapping station or stations where a radial strapping machine 28 mounted above the capstan arm can dispense securing straps that pass through the hollow core of the coil and around the end faces to provide a series of radial and longitudinal tension bands and a circumferential strapping machine 26 disposed along the coil car track can apply securing straps around the outer circumference of the wrapped coil.

The track terminates at an exit storage trough 30 where a number of the completely packaged coils can be held before dispatch. A weighing system (not shown) can be built into the storage trough to provide means for measuring the gross weight of the coil. Similarly other optional operations such as painting and marking can also be carried out at other stations.

Figure 3:
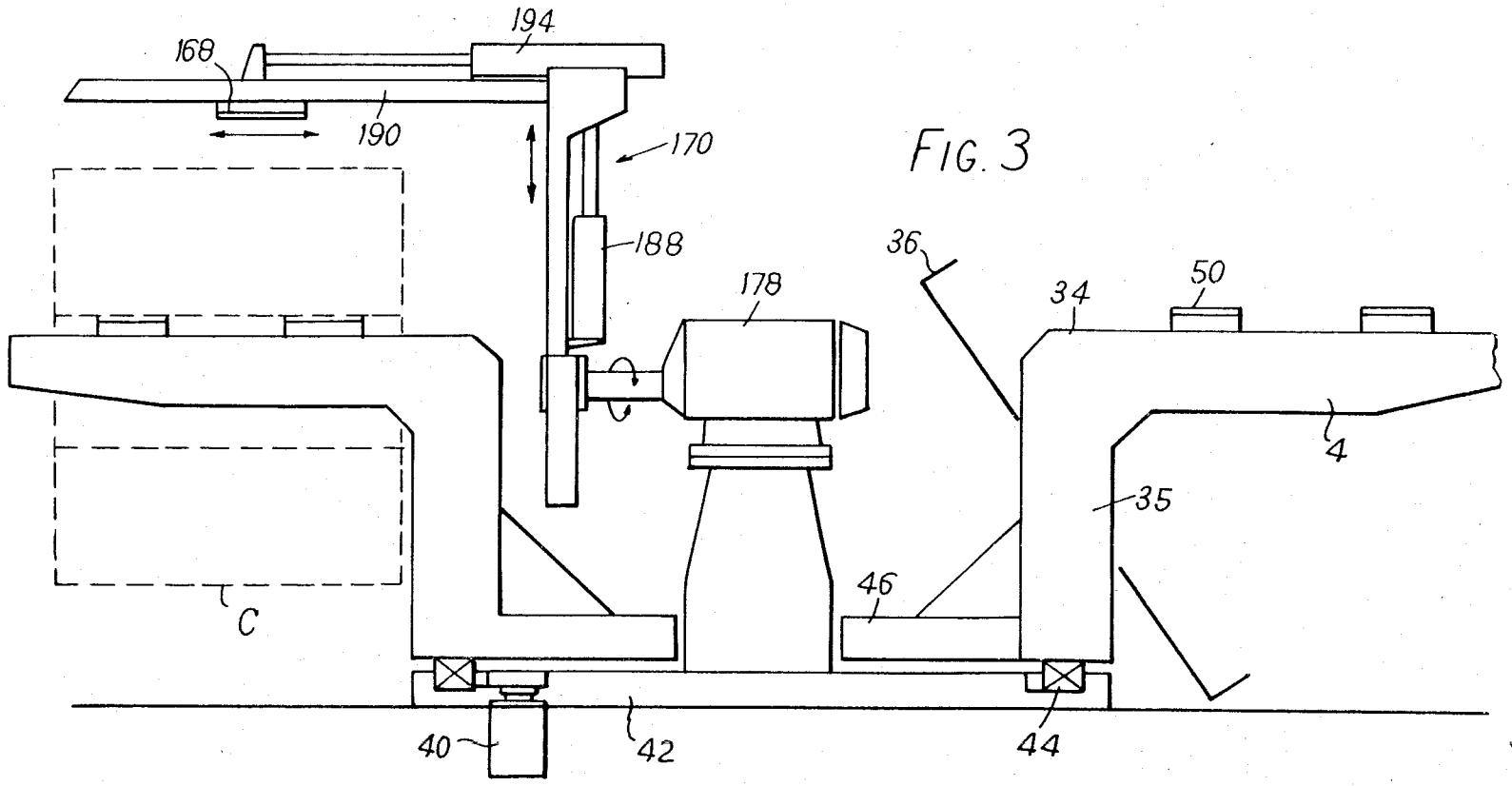
FIG. 3 is a partly sectioned side view of the rotatable transfer member in the installation of FIGS. 1 and 2, FIGS. 4 and 5 are side and front views of a coil car on its rail track in the installation of FIGS. 1 and 2, FIGS. 6*a* and 6*b* are side and front views respectively of a dispensing machine for a paper wrapping.

The capstan 2 is shown in more detail in FIG. 3. It is rotated by a motor 40 mounted on its base 42 and engaging a ring gear 44 fixed to a hub 46. A hydraulically operated wedge (not shown) is engageable with the hub 46 to locate the arms accurately in registration with the tracks. The wedge is automatically actuated by position sensing devices (not shown) so that it is extended only as the indexing movement is completed and is withdrawn again as the next indexing movement begins. On each of the arms there are movable bearer pads 50 with a curved top face to prevent damage to the coil or coil package. The capstan arms project from a knee bend 34 at their junction with upright stems 35 each spaced from the centre of the hub. The angled form of the stems and arms allows free access around the coil and also permits metal end caps 36 to be positioned on the arms, as shown, clear of the coil, and the wrapping arm assembly 24 to be located over the hub. This greatly facilitates paper wrapping operations on lines where coils will not be removed for fitting of the end caps.

Figure 4:
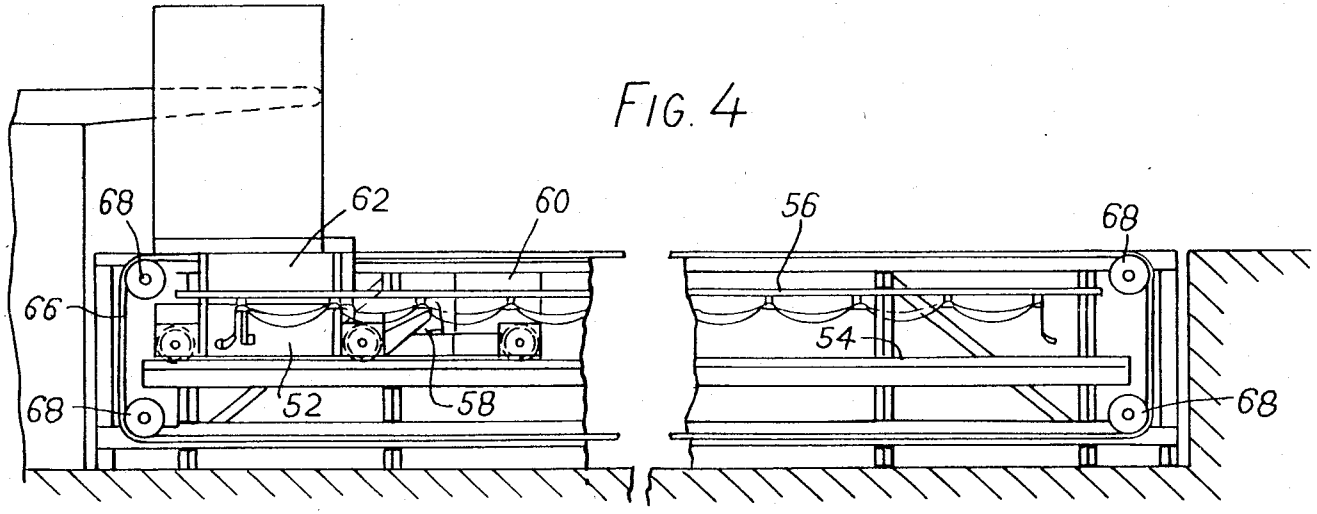
Figures 5, 8, 9:
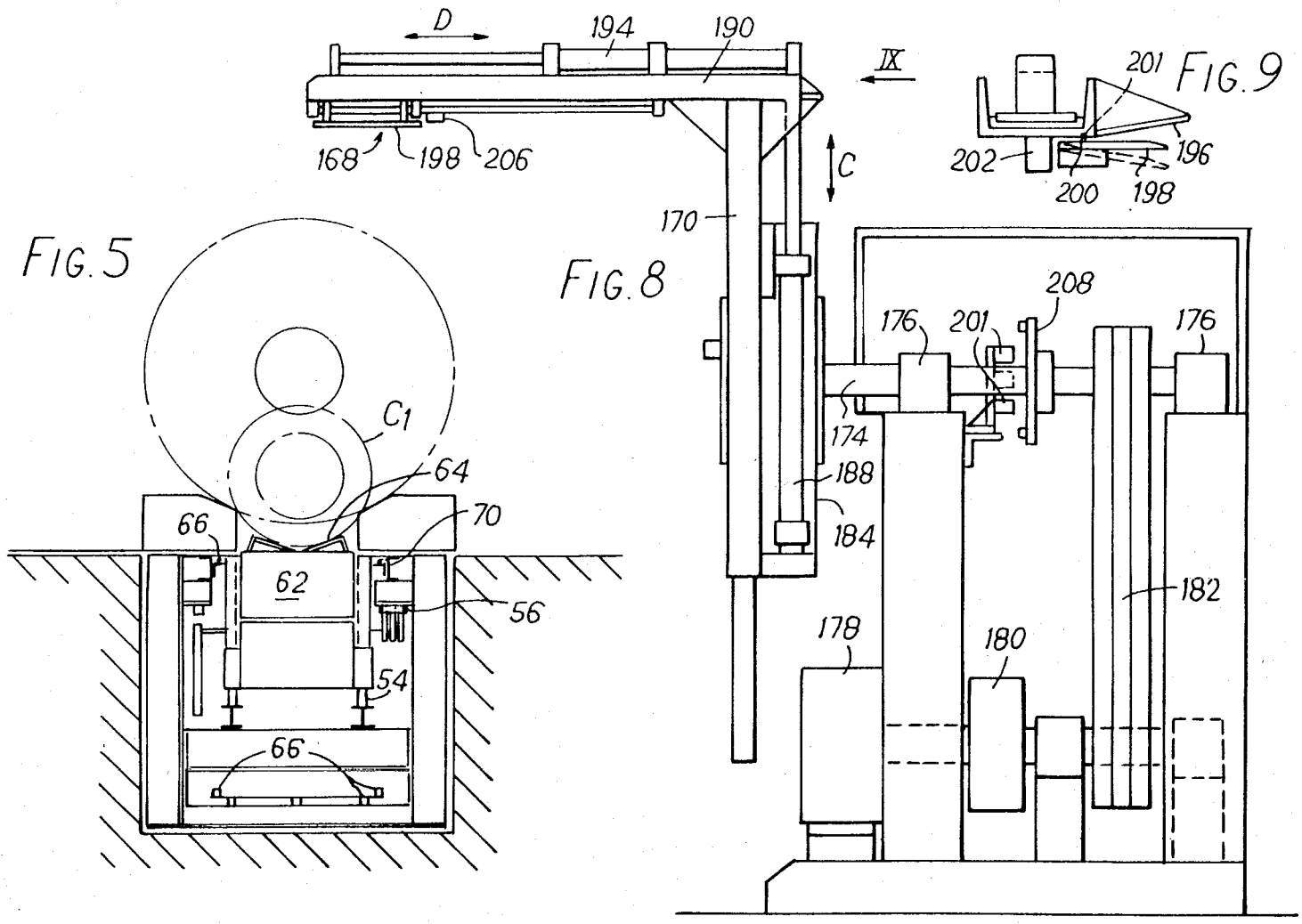
FIG. 8 is a front view of a wrapping arm unit for an outer sheet metal wrapping.
FIG. 9 is a detail view of the wrapping arm clamp.

Further features of the coil cars and their tracks can be seen in FIGS. 4 and 5. The coil car 10 comprises a trolley 52 running on rails 54. Motive power is taken from busbars 56 to drive an electric motor 58. The power supply can also be used to drive a hydraulic power pack 60 that operates rams (not shown) to raise and lower the load-carrying platform 62 on the trolley, but there can alternatively be flexible hose connections (not shown) to a static hydraulic pump and reservoir which can supply a number of coil cars. In the lowered position of the platform, the coil car can be run underneath the smallest coil anticipated, "$C_1$", as shown in FIG. 5. The maximum raised position is also governed by the smallest coil size and must be sufficient for the hollow core of the coil to clear the arms 4. The platform 62 has inclined top faces 64 forming a trough to hold the coils stably.

The shield plates 8 are attached to a pair of chain link belts 66 that are guided around sprockets 68 and fixed to the rail car trolley fore and aft, so that they and the shield plates move with the rail car. Fixed support flanges 70 underlie the upper run of the belts 66 to allow the floor level plates to support a weight.

In the operation of the installation, that coil in the entry trough 14 nearest the capstan 2 is lifted by the car 10*a*. Before being conveyed to the capstan it may be brought under an electrostatic spray unit (not shown) where a rust protection treatment is applied to the coil ends. The coil can also be weighed before wrapping if desired, the coil car 10*a* conveniently being provided with load cells (not shown) that allow this to be done automatically.

Figure 6B:
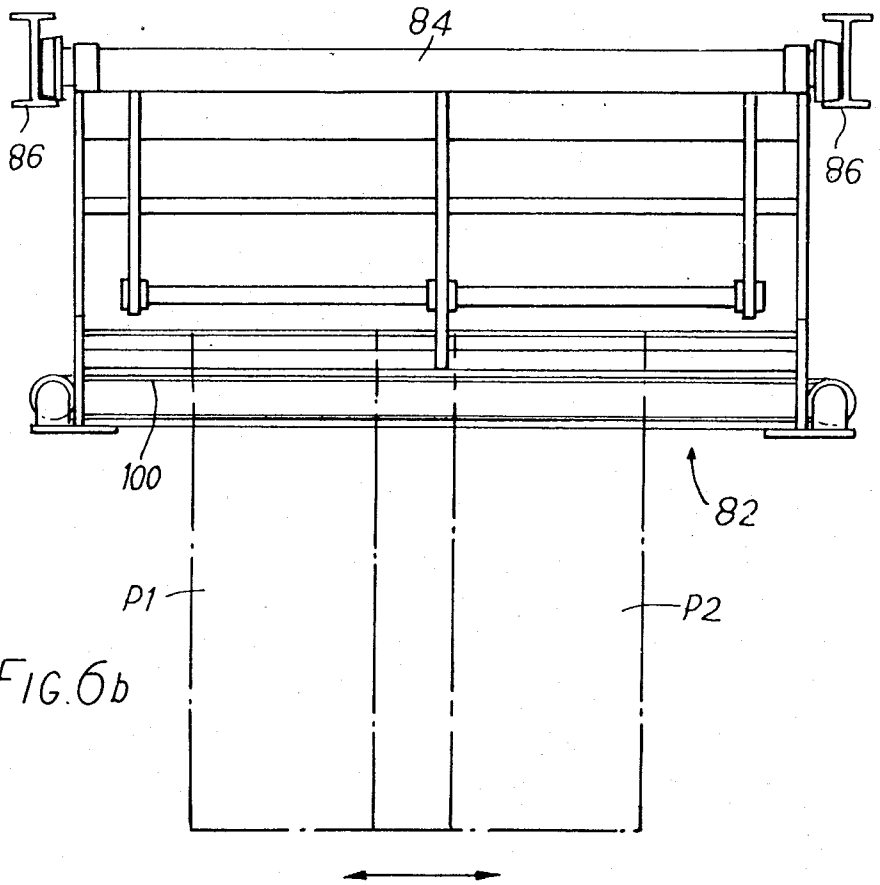
Figure 6A:
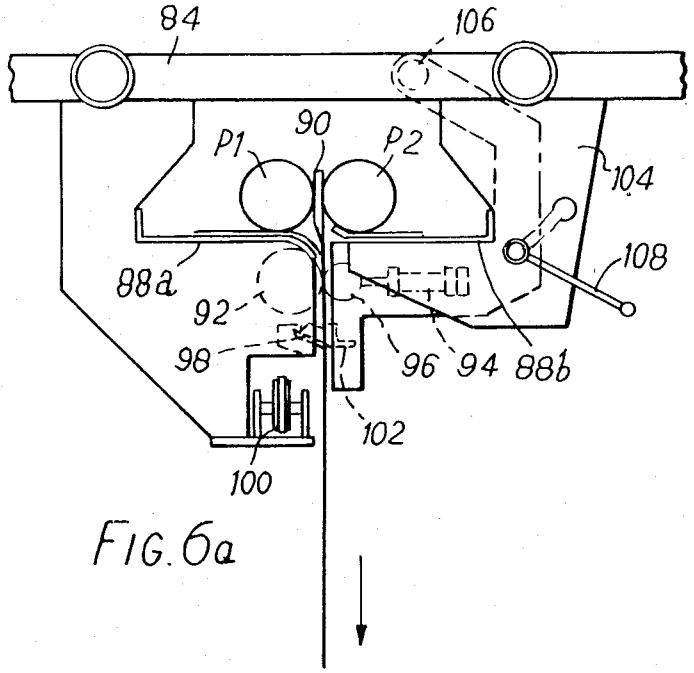

The coil car then places the coil on the transfer capstan 2, below the paper wrapping machine 80 which as shown in FIGS. 6*a* and 6*b* comprises a dispenser 82 that has a wheeled mounting frame 84 supported on an overhead gantry 86. In fixed positions within the frame, respective holders 88*a*, 88*b* for two paper rolls P1, P2 are separated by a dividing plate 90. The two rolls are held in axially overlapping relationship and bear against low friction surfaces as paper is drawn from both simultaneously by a drive roller 92 when the paper is pressed against it by the operation of ram 94 of an idler roller 96. Below the roller is a rotary shearing disc 98 that can be drawn by a cable cylinder 100 across the width of the paper to sever it from the rolls. The idler roller and a reaction plate 102 for the shearing disc are mounted on a yoke 104 that is pivotable on the frame 84 about an axis 106.

The rolls are each located between a pair of arms (not shown) that are displaceable laterally of the frame. The positions of the overlapping rolls can be adjusted to suit the width and position of the coil being wrapped. This is done as soon as sufficient paper has been fed out of the dispenser to touch the coil. Further paper is then fed out until there is enough to pull under the coil where it is attached with adhesive tape. The paper dispenser is traversed over the coil, thereby draping the paper over the top surface of the coil, and paper is then sheared such that the loose end drops down to be attached by tape to overlap the other end of the paper wrap. The outer wrap of paper is folded into the bore to complete the paper wrapping. The capstan then indexes through a further 90° and the coil is lifted off by the coil car 10*b*.

In use, the yoke is locked in the position illustrated, but when it is required to insert a new roll of paper and feed the starting end through, a clamp 108 can be rotated to release the yoke and permit it to be pivoted upwards until the clamp is registered with an upper clamping position. The end of the new roll can then be fed fairly easily through the wide gap that has been opened up, and when the yoke is lowered again and re-locked, the machine is ready for operation as soon as the new end of paper has been trimmed by the shearing disc.

The coil car conveys the coil to the support trough so that the steel end caps can be placed at each end of the coil and a pre-formed tube of steel is placed in the bore. A rotary disc cutting machine may be provided for cutting end blanks from steel sheet and a flanging machine for flanging the outer periphery of the blank to produce the end caps, but it is possible alternatively to provide flat end plates with separate roll-formed protective flanging rings. The coil is then re-positioned onto the capstan arm and the capstan indexes a further 90° to the steel wrapping station.

Figure 7A:
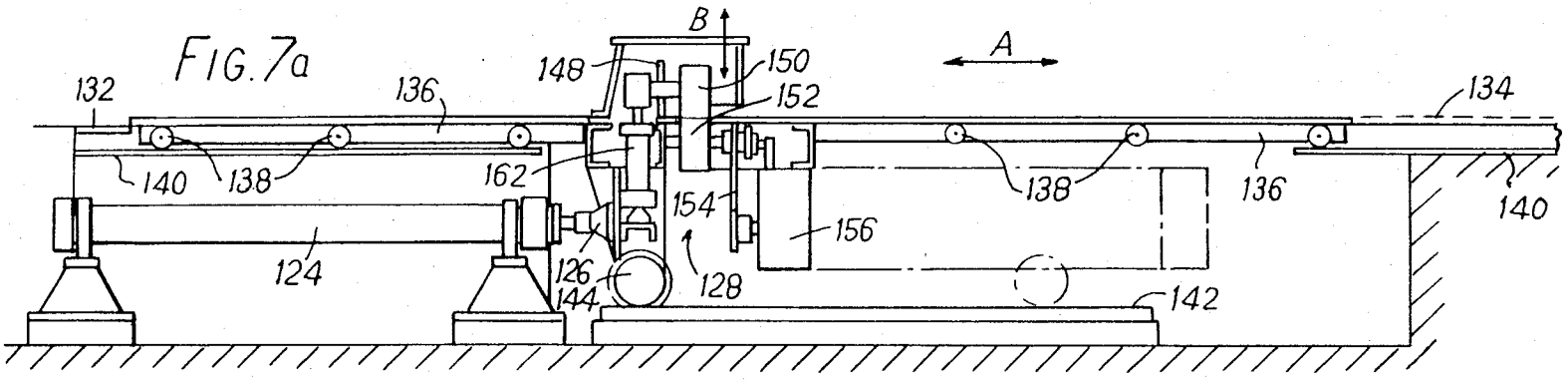
FIGS. 7*a* and 7*b* are partial end and plan views respectively of a metal wrapping sheet feed table.
Figure 7B:
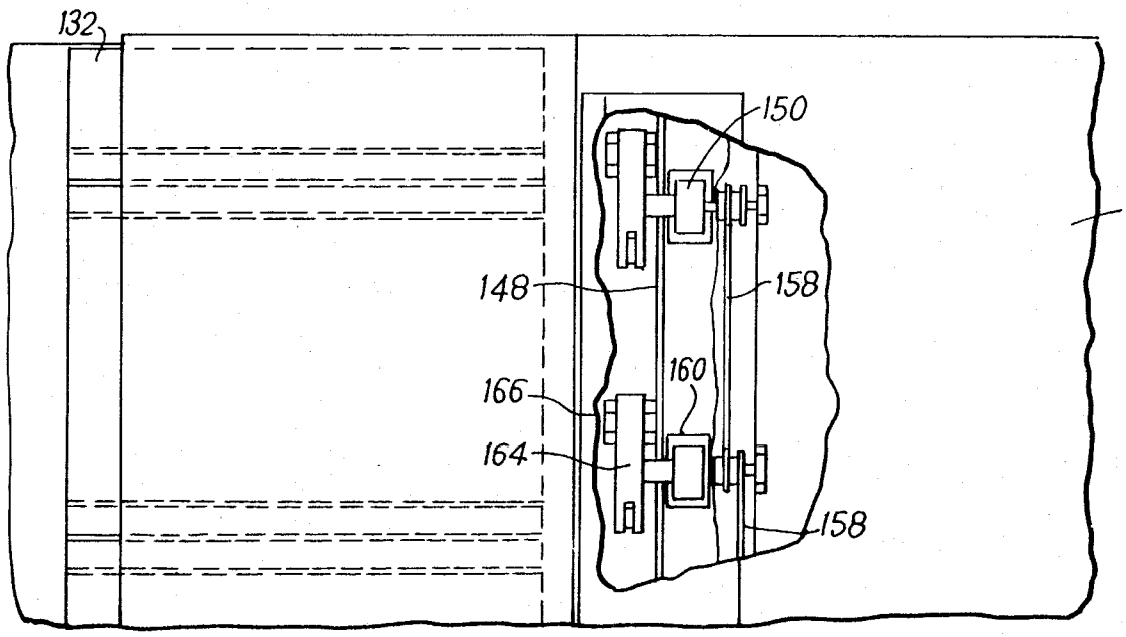

The outer steel wrapping is drawn off from a coil in a twin-cone uncoiler 116 by a combined pull-off and decurving rolls unit 118. The required length of sheet is determined by measurement of the coil diameter before it reaches the steel wrapping station and the sheet is cut by upcut shears 120 and delivered to the feed table 20, illustrated in more detail in FIGS. 7*a* and 7*b*. It comprises a platform 122 that can be displaced laterally, as indicated by the arrows A, by a hydraulic ram 124 attached to the platform substructure 126. Intermediate the width of the platform is a longitudinally extending guide and drive structure 128 dividing it into two sections, that section 130 to the right of the structure (as seen in FIGS. 7*a* and 7*b*) forming the support table for the wrapping sheet, while that to the left simply forms an overlapping leaf with a fixed cover 132 at floor level so as to prevent a gap opening when the platform is moved to the right. A similar fixed cover 134 lies underneath and to the right of the support table section 130. Through slots in the fixed covers 132, 134 depend support flanges 136 of the platform that carry wheels 138 running on fixed rails 140. Further transverse rails 142 are provided for wheels 144 that support the central part of the platform. These latter wheels are shown both in full and in broken lines at their opposite end limit positions.

The guide and drive structure is enclosed by a housing 146 that extends the length of the platform. For guidance of a wrapping sheet there is a fence 148 providing a lateral location for the edge of the sheet and pairs of upper and lower rollers 150, 152 adjacent the fence feed the sheet forwards. The lower rollers are driven by a chain drive 154 from an electric motor 156, the successive rollers being connected by respective chains 158. These rollers lie slightly below apertures 160 in the support table, so that the side edge of a wrapping sheet will not strike them if the sheet is fed laterally towards the fence 148. To introduce a wrapping sheet, the idler rollers can be lifted, as indicated by the arrows B, by respective hydraulic rams 162. These each act on one end of a lever 164 on which the roller is mounted between the ram attachment and an end pivot support 166. As the rams 162 contract they engage the sheet and pull it down slightly into the apertures 160 to hold it against the driving rollers 152. The idler rollers 150 are set at a small toe-in angle (about 1°–2°) so that as they rotate they urge an engaged sheet continuously against the fence 148 and so ensure that the sheet is kept correctly aligned.

The sheet is fed forwards by the roller to engage clamp 168 mounted on the steel wrapping arm unit which will now be described in more detail with reference to FIGS. 8 and 9, where the wrapping arm is illustrated as a free-standing structure. On a fixed base 172 a shaft 174 is mounted in bearings 176 and is rotated by a motor 178 operating through an overload slipping clutch 180 and a chain drive 182. Mounted on the shaft is a carrier 184 on which the wrapping arm 170 itself is supported to project radially, there being counterweights 186 projecting oppositely from the carrier. The wrapping arm 170 is radially displaceable on the carrier 184, as indicated by the arrows C, by a ram 188 connected between the carrier and the arm, to adjust it to the diameter of the coil. On the outer end of the arm is a clamping beam 190 directed parallel to the shaft rotary axis. The wrapping sheet clamp 168 is mounted on guides 192 on the beam 190 to be displaceable by a further ram 194, as indicated by the arrow D.

The clamp comprises a radially fixed inner guide plate 196 (FIG. 9) that forms a tapering entry region with a movable clamp jaw 198 shown in FIG. 9, both in its closed (full lines) and open (broken lines) positions, a further hydraulic motor 202 being provided for this movement. A pin 200 on the movable jaw enters a recess 201 in the fixed part of the clamp as the clamp closed.

In operation, a proximity switch 206 on the clamping beam 190 operates to stop the radially inwards contraction of the wrapping arm 170 on its carrier 184 automatically in order to set the beam 190 at the correct radial spacing from the coil, the arm 170 and carrier thus acting as a composite telescopic member. The end of the wrapping sheet is offered up to the clamping beam 190 with the beam disposed forwards of the coil and at a convenient height for the operator to lift the sheet into the clamping jaws before he operates the jaw-closing motor 202. The sheet is thereby gripped, and the pin 200 deforms it locally, forming a positive single point engagement about which the sheet can be pivoted if required. Lateral adjustments of the position of the sheet to align it to one side edge of the coil can then be made using the displacement ram 194 on the wrapping arm for the sheet clamp and the sheet is pivoted on the pin 200 for any angular adjustment that is required.

Once the sheet is correctly aligned the rotary shaft drive motor 178 is operated to carry the leading end of the sheet around the coil. A timing disc 208 on the shaft co-operates with further proximity switches 210, one of which acts to stop the wrapping arm when the tail end of the wrapping sheet has been brought close to the coil periphery. The operator then secures the tail end to the coil with adhesive strips and the rotary drive is started again. Since the tail of the sheet is restrained, a tension is produced in the wrapping sheet resulting in the overload clutch 180 slipping. The leading end of the sheet will then overlap the tail end and can be secured, e.g. by spot welds or by further adhesive tape, before the clamp is released.

A pair of wrapping sheets will normally be required to cover the full width of the coil, and so the wrapping cycle is repeated with a second sheet aligned to the opposite edge of the coil.

When the wrapping operation has been completed the wrapping arm is parked at a position that allows the coil to be moved away from it. In the case of a wrapping arm mounted on support in the central region of the capstan, the construction is generally similar. In this case it will be required to park the arm in the uppermost vertical position to leave the coil free to move as the capstan is indexed round.

Figure 11:
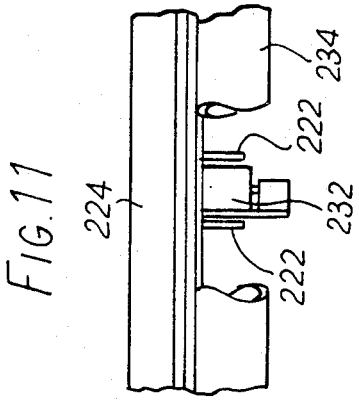
FIG. 11 is a detail sectional view on the line XI—XI in FIG. 10, FIGS. 12 and 13, 14 and 15, 16 and 17, 18 and 19 are pairs of detail views showing modifications of the apparatus in the preceding figures.
Figure 10:
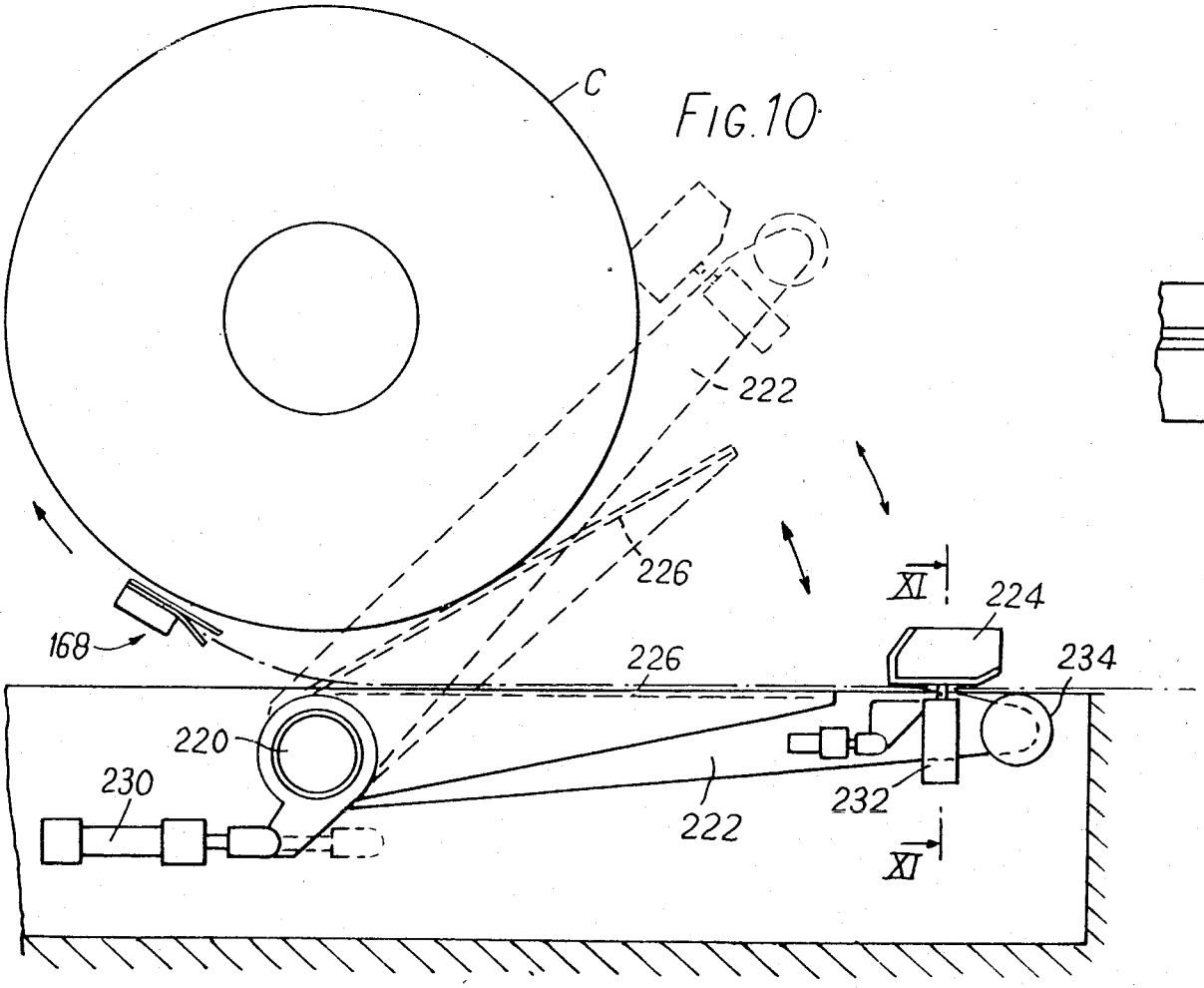
FIG. 10 is a side view of a welding arm unit for an outer sheet metal wrapping.

An alternative wrapping procedure is sometimes required when it is necessary to spot weld (or otherwise join) the two wrapping sheets together along their overlapping edges to prevent telescoping through rough handling. In this case the two wrapping sheets are fed to the wrapping arm clamp in sequence before the arm is rotated and the spot welding means shown in FIGS. 10 and 11 are employed.

These means are mounted on a pivot shaft 220 below the coil wrapping arm and comprise a spot welding arm 222 that is adjustable axially of the coil and shaft, a reaction bar 224, the pivot supports for which are not illustrated but which lie beyond the width of the coil, and a pressure plate 226 that extends across at least a major part of the width of the coil. The reaction bar 224 is supported slightly above floor level when not in use, so that the wrapping sheets are fed between it and the welding arm, and over the pressure plate, to the wrapping arm clamp 168.

Two actuators 230 are disposed laterally of each other, one for pivoting the spot welding arm 222, and with it the reaction bar 224, and the other for pivoting the pressure plate 226. The actuators are operated once the wrapping sheet end has been gripped by the wrapping arm clamp 168, and as the wrapping arm 170 is rotated a spot welding head 232 on the welding arm is operated to produce spot welds between the sheets at intervals along the overlapping margin of the sheets when they are held close to the coil by the bar 224 and a cylindrical bearer 234 on the welding arm. By using some of the proximity switches 210 on the timing disc 208, it is possible to stop the rotation of the wrapping arm at predetermined positions to space the spot welds. The welding tip of the head 232 of course reacts against the bar 224 which acts as an electrode to complete the circuit for the welding current. The bar also prevents transmission of heat to the coil and an inner layer of wrapping paper. When the welding operations are complete, the welding arm retracts to floor level, leaving the pressure plate 226 in contact with the coil to assist laying the leading ends of the wrapping sheets over the tail ends for final securing by adhesive tape or secondary spot welding.

It is a feature of this wrapping process that the welding of the sheets is performed on each region of their overlapping margins as that region has been formed to the required curvature against the coil. This is required because if the sheets were pre-welded while flat there would be buckling at the joint between them as they were wrapped around the coil.

A further alternative to the wrapping procedures described above requires that a single wrapping sheet of the correct width be wrapped around the coil. This requires that the sheet be slit to the coil width. Accordingly a simple lightweight slitter (not shown) of known design is installed between the shear 120 and the feed table 20. The wrapping cycle using the wrapping arm 170 then simply requires one operation without the need for the spot welding arm.

For those applications where the overlapping method is used wastage of wrapping steel can be minimised by providing a selection of coils of wrapping steel of various widths. These coils can be mounted on a multi-head uncoiler of known design which would be used instead of the twin head uncoiler 116.

The capstan indexes through a further 90° for radial straps to be applied by the radial strapping machine 28.

Figures 12, 13:
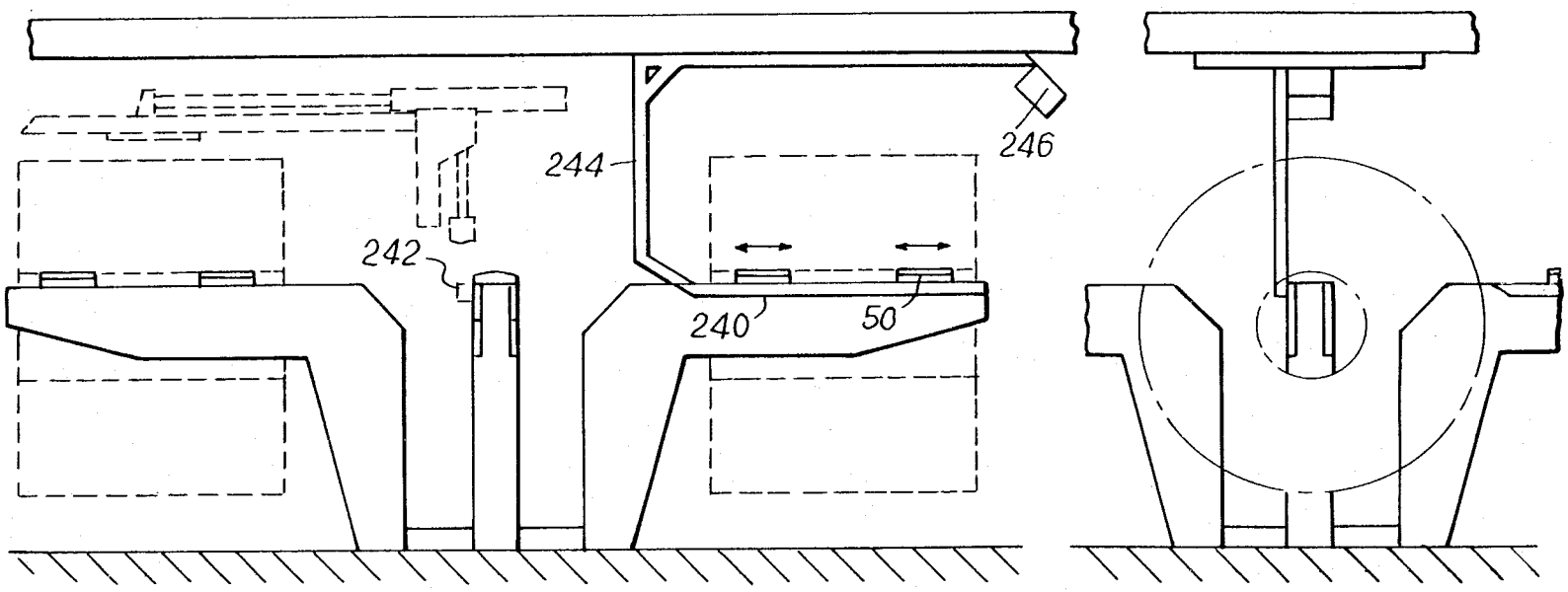

FIGS. 12 and 13 show further details of this. Strapping band guides are provided on the capstan arms 4, one such guide being formed as axial slots or grooves 240 in the bearer pads 50. Alternatively or additionally there is a band track 242 fixed to the side of the arm. These guides allow a strapping band to be passed through the bore of a coil mounted on the arm, track 242 is able to accommodate any number of straps which can be pulled out of the track to be fitted and be manipulated to the required position. This feature can be most useful in conjunction with a semi-automatic band feed system. By mounting a co-operating section of strap track 244 and a strap feed unit 246 above, the capstan bands can be dispensed through the slot 240 or the track 242 so eliminating the need for a separate eye or radial strapping station.

After the coil has been removed from the capstan arm by a coil car travelling on the exit path 6C from the capstan, the circumferential strapping machine 26 at a station along that path automatically dispenses loops of strap around the coil, tensioning and sealing them.

The coil may be automatically weighed while on the coil car or on the support trough and adhesive labels are produced printed with the coil weight, for attaching to the coil at the marker device 32. The coil car **10*c* finally deposits the packaged coil in the exit storage trough 34**. It will be understood that each indexing of the capstan can be employed to transfer coils to or from each of the four stations so that a number of coils can be handled by the apparatus at the same time.

It should be appreciated that the process described can be varied if desired. The steel wrapping station can be by-passed if paper only wraps are required, for example. Similarly both the paper and steel wrapping stations can be by-passed if the coil only requires banding and weighing.

Many other variations are possible; the number of tracks could be increased and the operations differently distributed among them if this is required to obtain an increased rate of throughput. Moreover, it will be appreciated that the extent to which the packaging process is operated automatically is largely a matter of choice.

Other possible modifications of the apparatus of the earlier figures are shown in FIGS. 14 to 19.

For handling the coils it may sometimes be desired to have the coil on a pallet before it exits from the apparatus. The pallet can be secured to the coil by means of tensioned bands either while the coil is on a capstan arm or after it has been removed. FIGS. 14 and 15 show a coil car with a modified load-carrying platform 252 that is raised and lowered by hydraulic ram 256 and that has slots 254 to allow the bands to be passed under the pallet while this is mounted on the coil car.

Figure 17:
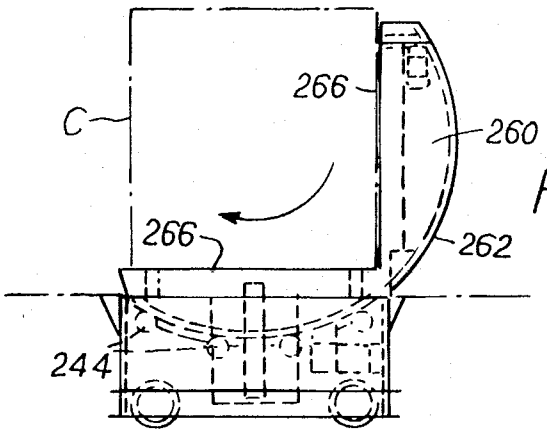
Figure 16:
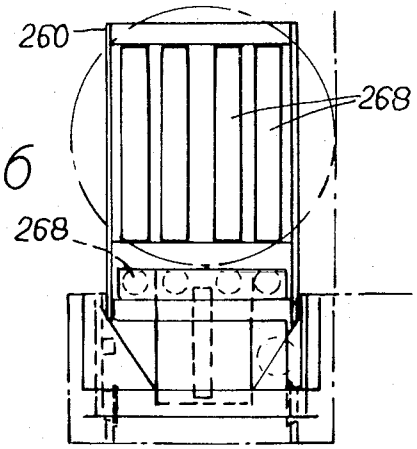

In an alternative shown in FIGS. 16 and 17 the coil car carries a cradle 260 with an arcuate outer track 262 resting on rollers 264 of the coil car so that the cradle can be pivoted about the track centre through 90°. Mutually perpendicular coil support faces 266 on the cradle, each composed of a series of parallel rollers 268, can therefore be displaced between vertical and horizontal orientations. This arrangement allows the coil car to remove a coil from a capstan arm and turn it through 90° so that it can then be carried away from the installation with its core axis vertical, which may be preferred in some instances. The rollers 268 of course facilitate the unloading of the coil from the coil car. It also allows a packaging crate, box or pallet to be placed over or adjacent to the coil while it is still on the capstan arm, the coil then being turned through 90° on the coil car leaving the coil upright in the box or on the pallet ready for further packaging.

Figure 19:
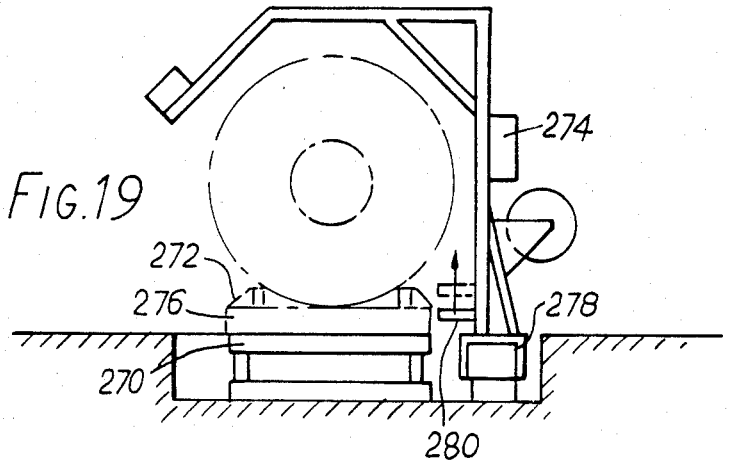
Figure 18:
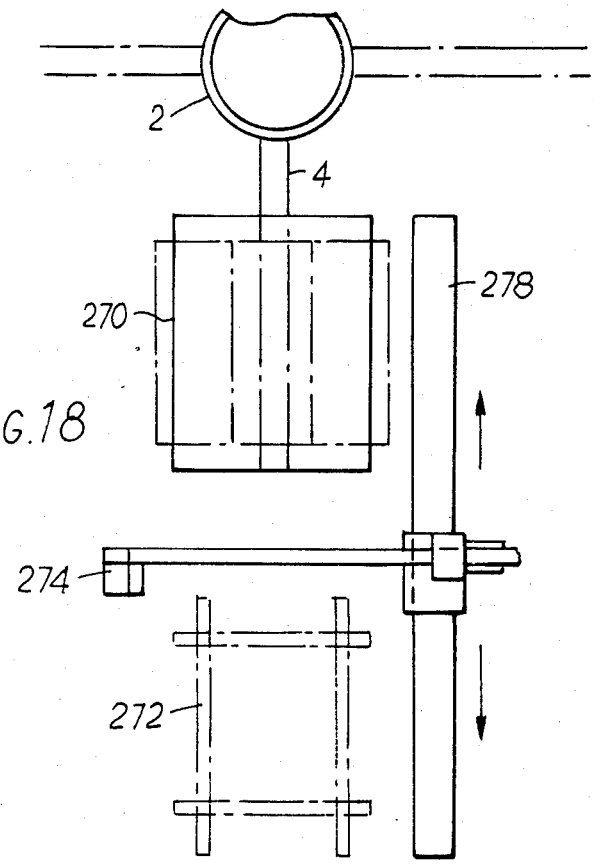

In certain cases it will be preferred to fix a pallet to the cylindrical surface of the coil while it is on a capstan arm. FIGS. 18 and 19 show the use of a scissors-lift pallet lifter 270 to raise a pallet 272 into contact with the underside of the coil C. The pallet can then be secured to the coil by tensioned straps dispensed from a strap feed unit 274. Preferably the unit 274 the bottom section of the strap guideway 280 of the unit 274 is mounted telescopically and is linked with pallet lifter so that straps can be fed between the pallet 272 and platform 276 of the lifter. As the pallet lifter rises it thus also lifts said bottom section so that the guideway is aligned with the top of the pallet lifter platform while the main part of the strap feed unit remains stationary, supported on fixed guide track 278. As previously described, the platform 186 can have transverse slots for passing straps more easily under the pallets. When not in use, as shown in FIG. 18, the strap feed unit 274 can be moved away on the track 278 running radially of the capstan 2 so as not to impede rotation of the capstan.

Figures 20, 21, 22:
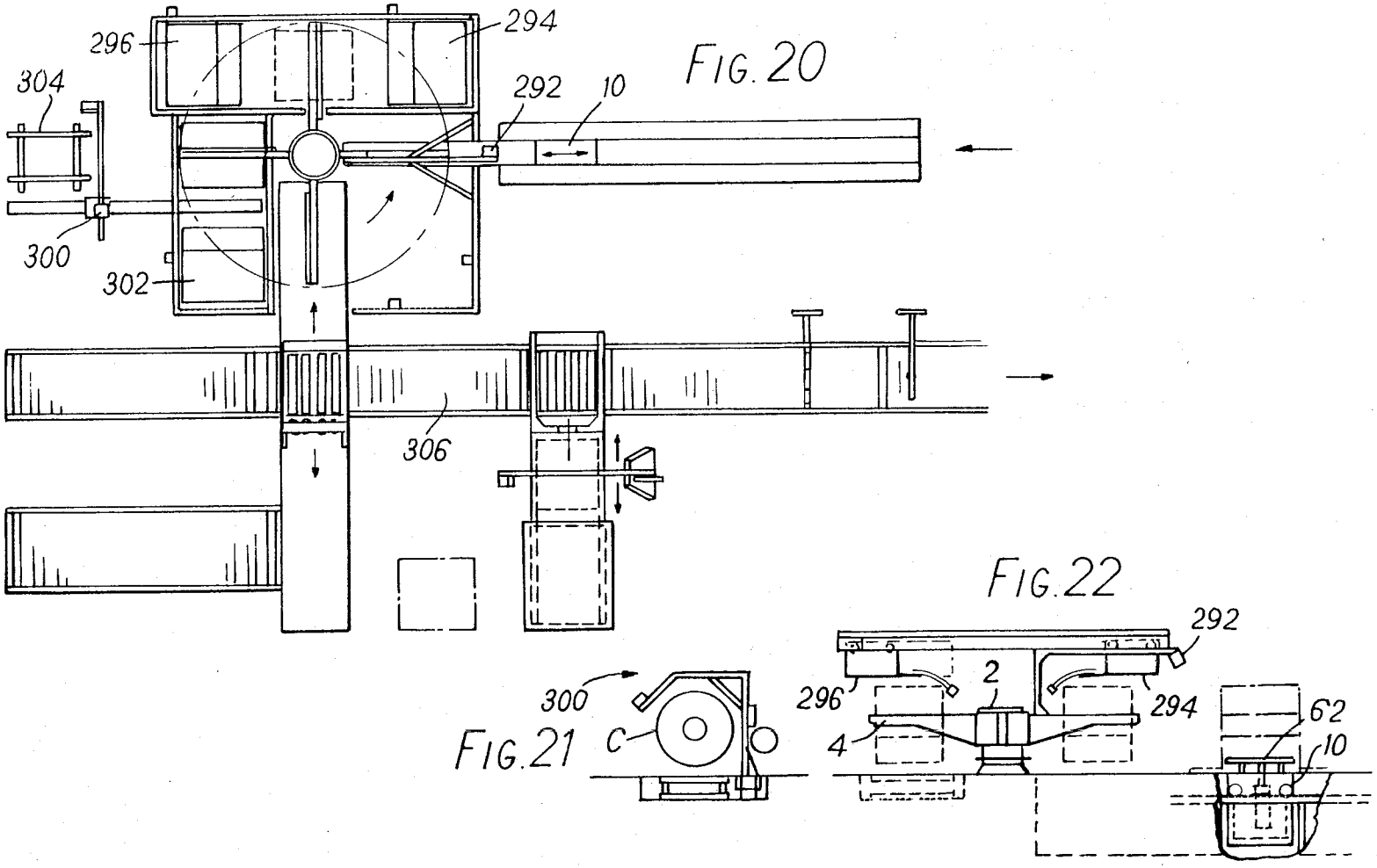
FIGS. 20 to 22 are a plan view and detail sectional views on the lines A—A and B—B respectively of FIG. 20, showing a further packaging installation according to the invention employing some of the devices shown in the preceding figures.

Another example of an installation in which a number of the packaging operations can be performed while a coil is on a capstan arm is shown in FIGS. 20 to 22 in which coils are delivered by a coil car 10 to a capstan 2, in the manner already described. At this stage, an eye strapping unit 292 may pass a band through the core of the coil, in the manner shown in FIGS. 12 and 13. The capstan then indexes through 90° and one or more wrapping sheets, e.g. of reinforced paper and/or plastics, is applied to the coil from dispensers 294, 296. Moving through a further 90° to the next station a number of optional steps of the packaging process may be performed. Thus, at this station there is provided a circumferential strapping unit 300, arranged in the manner shown in FIGS. 18 and 19, and also a further sheet wrapping dispenser 302. Pallets 304 can be presented to the coil at this station, as already described. At the fourth and final position of the capstan, a tilting platform coil car, of the form described with reference to FIGS. 16 and 17, is employed to remove the wrapped coil from the capstan and to transfer it to a further conveyor line 306 where further packaging operations may be performed. It will be appreciated that the arrangement described allows different forms of packaging to be applied to individual coils, in particular it provides a choice between palletising and crating the coils, as well as a choice of the number and type of wrapping layers to be applied.

It is a feature of the installation that it is also possible to handle narrow slit coils without difficulty. Thus, a number of such coils previously banded together can be mounted on a capstan arm in the same way as a wider strip coil. The operator can then break the straps holding the narrow coils together and it is easy to manipulate them on the arm so as to separate them and insert separating sheets of protective material between successive coils. The coils can then be strapped together while still on the capstan arm and processed as a unit through the required wrapping and other packaging stages.

I claim:

1. Apparatus for wrapping a sheet metal wrapping around a cylindrical coil of material having a hollow core, for covering essentially the entire outer peripheral surface of the coil, comprising:

a mounting extending through the hollow core of the coil for supporting it with its axis horizontal, a wrapping arm for holding the sheet metal wrapping to be applied to said outer peripheral surface of the coil, support means for said arm for supporting the arm rotatably about a horizontal axis substantially coincident with the coil axis, drive means for rotating the arm about said axis, a feed table for feeding sheets of the sheet metal wrapping in a direction essentially perpendicular to the axis of the coil, drive means on said table for advancing the metal wrapping sheets towards the wrapping arm and the suspended coil, a lateral edge guide on said table for wrapping sheets, said guide edge extending in the direction of feed of the feed table, and means for adjusting said guide axially of the coil and mounting for aligning the sheet axially with the coil, the wrapping arm comprising a member projecting from radially outer end of said wrapping arm parallel to the rotary axis and holding means on said member for sheets fed from the feed table, first adjustment means on said member for adjusting the position of the holding means axially relative to said rotary axis, and second adjustment means on said wrapping arm for adjusting the position of the holding means radially relative to said rotary axis.

2. Apparatus according to claim 1 wherein said wrapping arm is mounted telescopically upon the support means it for said arm to be extended for said radial adjustment of the holding means.

3. Apparatus according to claim 1 wherein proximity switch means are provided on said wrapping arm member for actuation by the coil, whereby to control said radial adjustment of the arm in dependence on the approach of said holding means to the coil.

4. Apparatus according to claim 1 wherein said wrapping arm member comprises a cantilever extending essentially parallel to the rotary axis, and guide means are provided on said cantilever for displacement of the holding means longitudinally thereof.

5. Apparatus according to claim 1 comprising indexing means for controlling the wrapping arm drive means, whereby to arrest the arm at at least one predetermined angular position about the rotary axis.

6. Apparatus according to claim 1, wherein said wrapping arm drive means comprises a drive transmission having a slipping clutch, whereby the rotation of the arm is arrested by an increased load sensed from a wrapping sheet attached to the coil as the wrapping sheet is pulled into tension around the coil.

7. Apparatus according to claim 1 wherein said table drive means comprise a series of pairs of lower and upper rollers for engaging a side marginal portion of said sheet adjacent said lateral guide.

8. Apparatus according to claim 7 wherein means are provided for raising the upper rollers of the pairs of rollers jointly to introduce the sheets between the upper and lower rollers.

9. Apparatus according to claim 1 wherein the table comprises a sheet support platform having openings adjacent the lateral guide through which the upper rollers project.

10. Apparatus for wrapping a sheet metal wrapping around a cylindrical coil of material having a hollow core, for covering essentially the entire outer peripheral surface of the coil, comprising:

a mounting extending through the hollow core of the coil for supporting said coil with its axis horizontal, a wrapping arm for holding the sheet metal wrapping to be applied to said outer peripheral surface of the coil, support means for said arm for supporting the arm rotatably about a horizontal axis substantially coincident with the coil axis, drive means for rotating the arm about said axis, feed means for feeding a plurality of sheets of the sheet metal wrapping in a direction essentially perpendicular to the axis of the coil and for locating said plurality of sheets adjacent the coil in a partially overlapped relationship transversely to said feed direction, a member projecting from a radially outer end of said wrapping arm parallel to the rotary axis and holding means on said member for sheets fed from the feed table, first adjustment means on said member for adjusting the position of the holding means axially relative to said rotary axis, and second adjustment means on said wrapping arm for adjusting the position of the holding means radially relative to said rotary axis, welding means adjacent the coil for the overlapped sheets, said welding means comprising a welding head, mounting means supporting the head and means for displacement of the head towards the coil for moving the sheets into close proximity to the coil and for securing together by welding the overlapped sheets curved around the coil by displacement of said welding means towards the coil.

11. Apparatus according to claim 10 further comprising a holding member and means for displacing said member towards and away from the coil to hold a wrapping sheet against the coil at a peripheral region thereof behind the holding means in the direction of rotation of the wrapping arm and between the holding means and the welding head.

12. Apparatus according to claim 11 wherein at least one of the welding head and the holding member is mounted on pivot means to be displaceable towards and away from the coil.

13. Apparatus according to claim 11 said holding member displacement means are adapted to be operated for retaining the holding member against a coil independently of the position of the welding head relative to the coil.

14. Apparatus according to claim 10 wherein the said welding means comprises a reaction member mounted at a distance from said welding head on said mounting means and between which reaction member and the welding head the wrapping sheets are fed, the head and reaction member being displaceable towards the coil by said displacement means to have an operative position in which the member bears against the coil.

* * * * *